United States Patent [19]

Ellion

[11] Patent Number: 4,984,140

[45] Date of Patent: Jan. 8, 1991

[54] HAND HELD FLASHLIGHT WITH SELECTIVE BEAM AND ENHANCED APPARENT BRIGHTNESS

[76] Inventor: M. Edmund Ellion, 2152 Highland Oaks Dr., Arcadia, Calif. 91006

[21] Appl. No.: 382,426

[22] Filed: Jul. 19, 1989

[51] Int. Cl.[5] ..... F21L 15/02

[52] U.S. Cl. ..... 362/187; 362/280; 362/304; 362/349

[58] Field of Search ..... 362/157, 187, 188, 277, 362/280, 298, 302, 304, 346, 349

[56] References Cited

U.S. PATENT DOCUMENTS 2,947,851 8/1960 Lozeau ..... 362/187

4,807,097 2/1989 Gammache ..... 362/187 X

*Primary Examiner*—Stephen F. Husar

*Attorney, Agent, or Firm*—Donald D. Mon

[57] ABSTRACT

This invention produces a spot beam or a broad beam having no unilluminated regions within the beam. In one case, the size of the beam is established by the relative position of the light bulb and a uniquely shaped reflector. The apparaent brightness of the beam is established by oscillating the beam in a controlled fashion. In another case, both the size of the beam and the apparent brightness are established by oscillating the beam in a controlled fashion. The result of this invention is a spot beam that can be made into a broad beam without the dark regions that result from the existing adjustment techniques and also a broad beam having an apparent brightness greater than that attainable by other techniques.

5 Claims, 6 Drawing Sheets

THE BROCA-SULZER PHENOMENON (OSCILLATION BEFORE THE ATTAINMENT OF EQUILIBRIUM)

PIXELS

| | 1 | 2 | 3 | 4 | 5 |
|---|---|---|---|---|---|
| 0. | I | X | X | X | X |
| 1. | I | X | X | X | X |
| 2. | X | I | X | X | X |
| 3. | X | X | I | X | X |
| 4. | X | X | X | I | X |
| 5. | X | X | X | X | I |
| 6. | X | X | X | X | I |
| 7. | X | X | X | I | X |
| 8. | X | X | I | X | X |
| 9. | X | I | X | X | X |
| 10. | I | X | X | X | X |
| 11. | I | X | X | X | X |
| 12. | X | I | X | X | X |
| 13. | X | X | I | X | X |
| 14. | X | X | X | I | X |
| 15. | X | X | X | X | I |
| 16. | X | X | X | X | I |

TIME

PIXELS

| | 1 | 2 | 3 | 4 | 5 |
|---|---|---|---|---|---|
| 1. | I | X | X | X | X |
| 2. | X | I | X | X | X |
| 3. | X | X | I | X | X |
| 4. | X | X | X | I | X |
| 5. | X | X | X | X | I |
| 6. | I | X | X | X | X |
| 7. | X | I | X | X | X |
| 8. | X | X | I | X | X |
| 9. | X | X | X | I | X |
| 10. | X | X | X | X | I |

SLOW

FAST

TIME

HAND HELD FLASHLIGHT WITH SELECTIVE BEAM AND ENHANCED APPARENT BRIGHTNESS

FIELD OF THE INVENTION

This invention relates to hand-held flashlights with selectable beam sizes and enhanced perceived brightness.

BACKGROUND OF THE INVENTION

The conventional flashlight employs a parabolic reflector to direct the light from the bulb to the object to be illuminated. When the bulb is at the focus of the paraboloid, all of the light rays leaving the bulb and impacting on the surface of the reflector will travel the same distance as they emerge parallel to the axis. The result is a bright concentrated spot beam. In order to form a broad beam with common flashlights, the light bulb is moved relative to the paraboloid so that the bulb is no longer at the focus. The result is that the light rays leaving the bulb reflect off of the parabolic surface and emerge diverging from the axis. The broad beam formed is less bright by at least the increase in the beam area over the spot. In addition, it will have an unilluminated spot at the center of the broad beam. This dark area is due to the light rays originating at a location other than the focus of the parabolic reflector. The resulting broad beam is much duller than the spot beam and there is a center area that is not illuminated.

It is an object of this invention to produce a spot beam that can be broadened to illuminate a wide area, but having no dark regions.

Yet another object of this invention is to produce a broad beam which has an apparent or perceived brightness that is greater than a beam which is attainable by existing techniques.

BRIEF DESCRIPTION OF THE INVENTION

A flashlight according to this invention has a central axis along which its light beam is projected. In its simplest form it includes a reflector having a parabolic base, and a concentric zone of a cone spaced apart along the axis. A spot beam is produced by the paraboloid when the light is at the focus. A broadened beam is produced when the light is not at the focus, with the paraboloid and the cone together producing a beam without a non-illuminated center.

According to a preferred but optional feature of the invention the beam is moved laterally or rotationally at a specific velocity and frequency to result in a perceived increase in brightness of the beam without requiring greater luminous flux from the light.

The above and other features of this invention with be fully understood from the following detailed description and the accompanying drawings, in which:

DETAILED DESCRIPTION OF THE INVENTION

In order to understand the background technology and the teachings of this invention, it will be helpful to review some fundamental facts of light reflection and the human eye.

Figure 1:
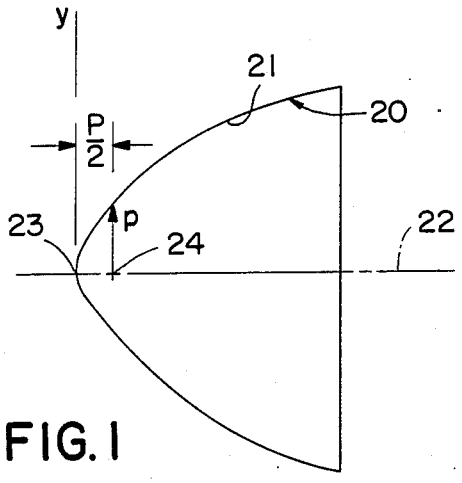
FIG. 1 is an axial cross-section of a paraboloid showing the definitive geometry of a parabola, of which a paraboloid is its surface of revolution.

The existing technique for controlling the size of a flashlight beam is to move the light bulb relative to the focus of the parabolic reflector, or the reflector relative to the bulb, which is the same thing. When the bulb is located at the focus of the paraboloid, all reflected light rays will be caused to travel in parallel paths to result in a spot beam. The reason for this condition should be understood in order to follow the teachings of this invention. It can be understood by considering FIG. 1, which is an axial cross-section showing a two dimensional planar parabola 20 in place of the paraboloid that is actually used. A paraboloid is a three dimensional surface of revolution created by a parabola rotated about its axis to form it. Reflecting surface 21 of the parabola is defined by the equation $y^2=2px$, where y is measured laterally from the axis of symmetry 22 and x is measured from the apex of the parabola. The constant p is the value of y at the focus 24. In this and in the other FIGS., the focus is denoted by a cross.

For a polished surface, the angle of reflection of any ray is equal to the angle of incidence. It is fundamental and well-known that a polished reflecting surface shaped as a paraboloid projects a spot beam of parallel light rays when the bulb is at the focus.

Figure 2:
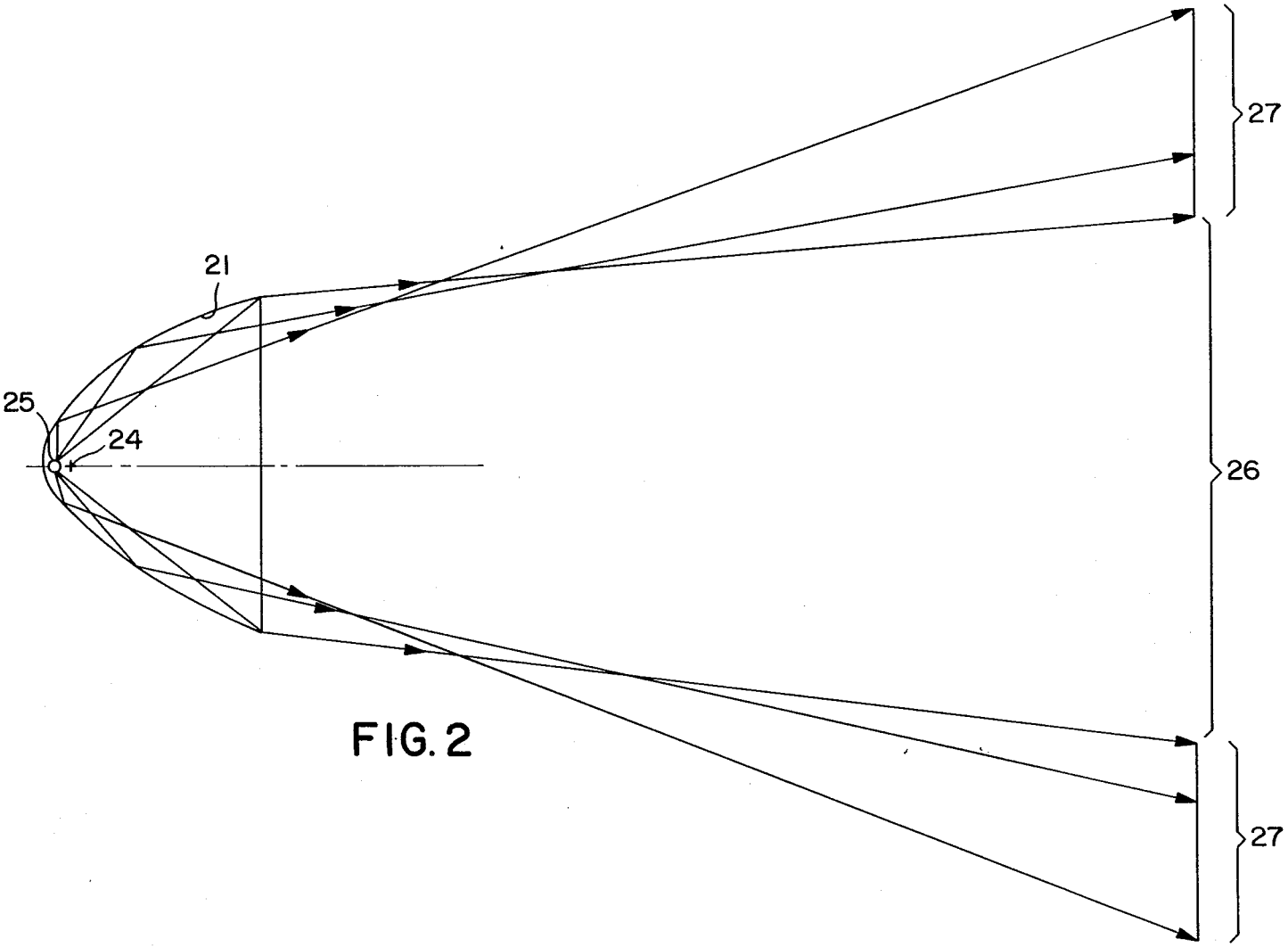
FIG. 2 is a geometric drawing showing the light pattern projected by a paraboloid when the light source is between the focus and the reflector.
Figure 3:
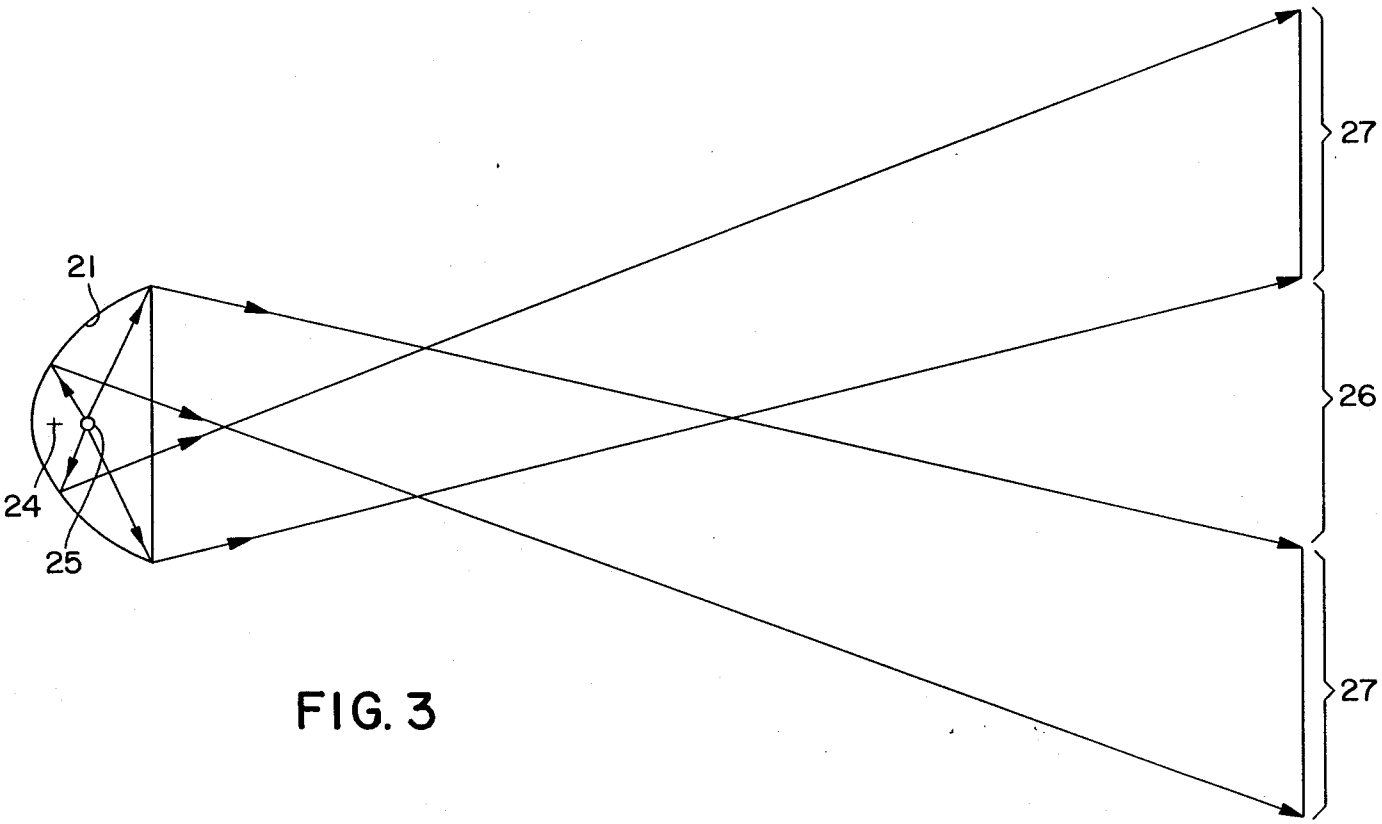
FIG. 3 is a geometric drawing showing the light pattern projected by a paraboloid when the light source is on the other side of the focus from the reflector.

However, if the bulb is moved axially off of the focus either toward the reflector or away from it, this relationship no longer holds. Throughout this application, the location of the bulb will be indicated by a small circle. The rays are then reflected from the bulb either in a diverging fashion away from the axis of the parabola if the bulb is at a value of x that is less than p/2 (that is between the focus and the reflector) or in a fashion that crosses over the axis if the bulb is at a value of x that is more than p/2 (that is, on the other side of the focus from the reflector). FIGS. 2 and 3 illustrate these conditions, relative to the paraboloid of FIG. 1. In these FIGS. light source (bulb) 25 is shown axially displaced from focus 24. Examination of these FIGS. will show that an unilluminated circular region 26 will occur in both cases at the center of the area to which the flashlight is pointing, in the center of an illuminated annular ring 27. This dark region is precisely at the center of the area the user wishes to illuminate and consequently is highly undesirable. The size of the dark spot is defined by the light having the minimum deflection angle from the center line of the paraboloid (i.e. the light reflected from the parabolic surface at the maximum value of y) and is a function of the displacement of the bulb relative to the focus. The actual size varies linearly with the distance to the object being illuminated. In a typical flashlight, this unilluminated spot is approximately one-quarter of the broad beam area. It is an object of this invention to provide a reflector having a unique geometry that can be adjusted from a spot beam to a broad beam and still have no unilluminated regions.

It is another objective of this invention to provide a method to cause objects that are illuminated to appear brighter than they do with existing flashlights. A brief discussion of the operation of the human eye will be helpful in clarifying this second objective.

Figure 7:
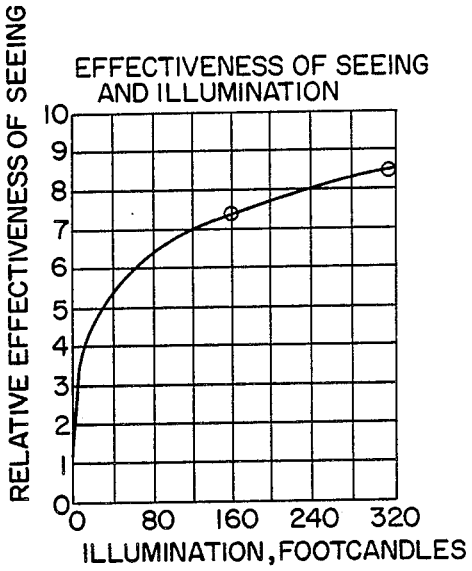
FIG. 7 is a graph showing the relationship between perceived (apparent) brightness and actual brightness.

In its simplest form, the human eye has functions similar to a camera: a lens to form the image from the entering light waves, an iris (diaphragm) to regulate the amount of light, and the retina (film) that is sensitive to light for recording the image. After the light hits the light sensitive retina, the stimulations are carried by the optic nerve to the visual cortex area in the rear of the brain. The apparent intensity that the observer experiences is not a linear function of the actual intensity but varies in a logarithmic fashion. Examination of the curve in FIG. 7 shows that a decrease of 50 percent (from 320 foot candles to 160) will result in apparent reduction in perceived brightness of only 12 percent (from 8.3 to 7.3).

The brain does not perceive the light as soon as it impacts on the retina but about 0.1 second later. Also, when the light ceases to enter the eye, the brain still perceives the image for a time greater than the delay time of 0.1 second under some conditions. It is this after-image that makes the Hawaiian torch dancer appear to have a ring of fire rather than merely a spot flame. Similarly, it is this after-image effect that makes movements in a motion picture appear to be smooth and continuous in spite of the fact that they may be flashing at only 24 frames per second.

The human eye is considerably more complex than the above simple model and in order to fully understand this invention, it will be necessary to describe a few more detailed functions of the retina. The retina is made up of several layers of cells that are directly involved in the visual process. The principal cells of interest for this discussion are the rods and the cones, which are the light sensitive cells. The region of the retina where the sharpest vision occurs is called the fovea centralis and is located almost directly in line with the lens at the rear of the eye. In the central region of the fovea there are only the light sensitive cells called cones. Toward the edges of the fovea there are some other types of light sensitive cells called rods. In the area of the retina farther away from the fovea, there are more rods and fewer cones. The rods respond to the lower levels of illumination and the cones respond to the higher levels. The total number of cones in a human retina is approximately 7,000,000 while there are about 100,000,000 rods. Since there are only approximately 1,000,000 optic nerve fibers connecting the retina signal to the brain, many of the signals must be combined before transfer to the visual cortex.

The rods and cones contain a substance that absorbs light energy and converts electromagnetic vibrational type of energy into a form of electrical charge that stimulates the brain. This substance is called rhodopsin or visual purple. Rhodopsin is a chromo-protein made up of the protein, opsin, with a pigment-bearing chromatophere. The amount of rhodopsin increases greatly in the retina of an eye that has been kept in the dark for several minutes. Conversely, the amount of rhodopsin decreases with the amount of light entering the retina. The high sensitivity of the rods to light as compared to the cones is due to the relatively high amounts of rhodopsin in the rods.

While only a few components of the very complex human eye have been discussed, this is sufficient to understand the teachings of this invention.

Numerous investigators have studied the threshold for light sensation. The threshold level is defined as the minimum intensity that an observer can perceive the light. This threshold level is sensitive to many conditions such as when the observer's eyes are dark-adapted by being in a dark room for several minutes prior to the test or if the observer does not look directly at the illuminated object. In the former case, the observer's iris opens so that more light can enter and stimulate the retina and also more rhodopsin is formed to make the retina more sensitive. In the latter case, glancing away from the dimly lighted object allows the image to fall on the area of the retina away from the fovea (which has only cones) and thus in an area with more rods which are more sensitive to light.

Experiments on the spatial summation of light have shown a relationship called Ricco's law which states that the threshold intensity multiplied by the area of the retina that is stimulated is equal to a constant. Thus, the amount of light energy needed for an observer to just perceive the light may be 100 quanta per rod if only one rod in the retina is stimulated but would be only one quantum per rod if 100 rods are stimulated. The amount of light called a quantum is equal to Planck's constant times the frequency of the light. Thus Ricco's law states that, in spatial summation over an area of rods, the effect is merely additive.

For temporal summation, the visual effects are far more complex, and it is the time effects that form most of the basis for this invention. Time effects of interest for this invention are experienced for very short duration lights, for a train of flashing lights, and for phenomena known as after-images that occur after the light source is shut off.

It has been mentioned previously that after-images cause motion pictures to appear continuous and the Hawaiian torch dancer to have a flaming ring instead of a spot flame. This phenomenon can now be discussed further.

Flicker is defined as the sensation an observer has when a source of light is turned on and off at relatively slow speeds. At even slower speeds, the observer sees definite dark and light flashes, and at higher speeds the observer experiences no sensation of changes in light intensity. The flashing rate where there is no sensation of change is called the critical fusion frequency (cff). At high levels of illumination the cff required may be 60 cycles per second (hertz) while for lower levels of illumination the off may only be 4 hertz. The response of a stimulation of the rod to a low luminance lasts much longer than for the cone that is stimulated by high luminance. Thus the low luminance level off is much lower. As a result, if a rod is stimulated by a low intensity flash and is then exposed to darkness for up to ¼ second before the next flash, the observer will not experience any sense of a flickering light while the same exposure at high intensity would cause the observer to see definite bright and dark flashes. The difference is thought to be the response times for the rod or cone activity as a result of the amount of rhodopsin in each. As a quantitative rule, the Ferry-Porter law states that at high levels of illumination when the cone vision is employed, the off increases with luminance in a logarithmic fashion. The lower off at illumination levels of a flash light will be applied in this invention.

Experiments by Hagins indicated that only 50 percent of the total rhodopsin in an area is affected for each exposure to a light flash under some conditions. Each successive flash causes 50 percent of the remaining rhodopsin to be affected. Thus the human eye acts in a summation fashion under some conditions. The Bunsen-Rosco law states that for *threshold* perception the intensity of the light multiplied by the time of exposure is equal to a constant for exposures of less than 0.1 seconds. Thus, in this case, temporal summation is similar to spatial summation in that two stimuli, each being 50 percent too weak to be recognized will cause a sensation if falling for twice the duration or in rapid succession on the same area of the retina. It has been determined that the total number of quanta that are required to excite vision are 130. This is true regardless of being obtained in a steady fashion or a flashing series that adds up to 130 quanta. However, if the time for the retina to receive the 130 quanta exceeds 0.1 seconds, the Bunsen-Rocco law no longer holds true. At times exceeding 0.1 seconds, the number of quanta required to excite an image is greater. (e.g. at one second, it is 220 quanta). For a series of flashes, Bloch's law states that at threshold illumination levels, the apparent luminance of a source of light that emits flashes at very short durations is merely the integral over the period.

The Talbot-Plateau law states that for *any* intensity of a flashing light at rates exceeding off, the apparent luminance will be merely the average luminance during the flashing cycle. This same relation is given by Bloch's law for threshold levels of illumination.

At certain flashing frequencies and certain on/off times, however, a very important phenomenon takes place that is called "initial fluctuations" which does not follow Talbot-Plateau law or the Bloch law. Broca and Sulzar found for steady exposure that for low levels of luminance (below one troland) the apparent brightness of a single flash increased asymptotically with the duration of the flash to the actual brightness. At higher luminance well above the threshold level, the apparent brightness of a flash *exceeds* the actual brightness by an appreciable amount.

Figure 8:
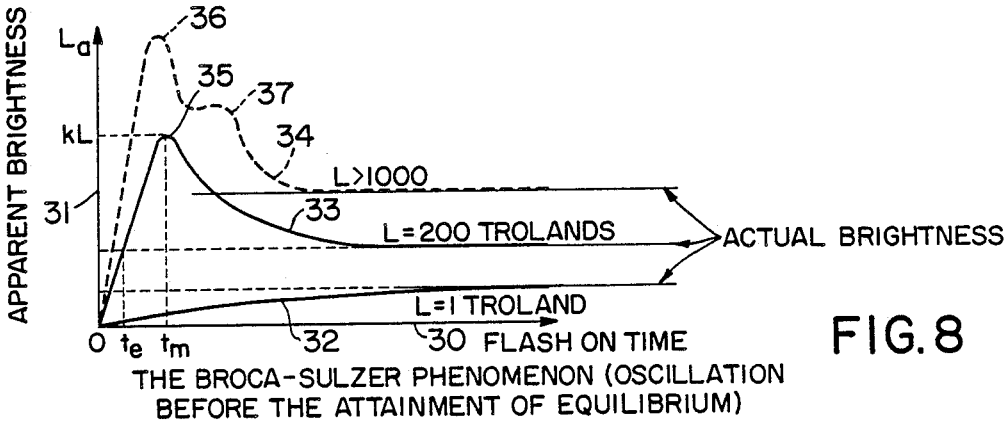
FIG. 8 is a graph showing the relationship between perceived (apparent) brightness and actual brightness for short pulses of light.

FIG. 8 illustrates several facets of this phenomenon. Its abscissa is the flash on time. The horizontal asymptotic line 30 is the actual brightness. The ordinate 31 is the apparent or perceived brightness. Curves 32, 33 and 34 represent the apparent brightness perceived by a flash of respectively low actual brightness (about 1 troland), a medium brightness (about 200 trolands), and a substantial brightness (over about 1,000 trolands). In each case, the perceived brightness finally becomes identical to the actual brightness. This is exemplified by the parallelism of the graphs at the right-hand end of the FIG.

However, their interim perceived brightness is another matter. At the low level of curve 32, the perceived brightness does not equal the actual brightness until a substantial time interval.

Now notice the peak 35 on curve 33, and peaks 36, 37 on curve 34. In these cases, arising from substantial illumination levels, there is an early quite large perceived brilliance substantially in excess of the actual brightness, and the perceived brightness remains higher than the actual brightness for a substantial period of time. Here is an opportunity to amplify the perceived brilliance of a given light source.

A similar effect for a train of flashes was reported first by Brewster and further investigated by Brucke. They found that a slowly flashing light would produce an *apparent brightness considerably greater* than the same light at either steady illumination or at frequencies greatly exceeding the critical fusion frequency. This phenomenon that the apparent brightness exceeds the actual brightness of a train of flashes is usually called the Brucke effect. The greatest effect was observed at a flashing rate of 10 hertz and for a flash that was on about 25 percent of the time. This effect together with the lower off flashlight illumination levels will be employed in this invention.

It has now been discussed that at certain frequencies and levels of luminance a flashing light will appear steady and will appear considerably brighter than a steady light of the same intensity. It is now possible to describe this invention that employs the use of these phenomena together with the unique compound reflector of this invention which produces a beam without dark spots or rings.

One teaching of this invention consists of a reflector that has a unique configuration to cause the flashlight beam to transform from a bright spot beam to a broad beam that has no unilluminated regions such as rings or a central spot.

As previously stated, FIGS. 2 and 3 illustrate a conventional parabolic reflector with the light bulb displaceable from the focus. It has been shown above that the resulting broad beam would have a dark spot 26 in the critical center area. Illuminated ring 27 is a bright ring (shown in section). In order to show how a reflector that is designed according to the teachings of this invention can eliminate the dark region of the broad beam and still not degrade the bright spot beam, it will be helpful to present some actual dimensions for a flashlight reflector.

A typical flashlight employs a conventional parabolic reflector having a minimum diameter of 0.600 inch to accommodate the light bulb and a convenient maximum diameter of two inches or more. The light bulb is displaced about 0.2 inches in order to change the spot to a broad beam. It requires no effort for a skilled person to device a suitable simple parabolic reflector.

It is instructive to observe that when the bulb is moved either way from the focus, a dark spot will appear in the center of the beam. Inspection of the ray traces in FIGS. 2 and 3 show how this occurs. Thus, with a simple parabolic reflector, a broader beam has a dark center spot.

In fact, a conventional 2 inch diameter parabolic reflector which projects a good beam when the light bulb is at the focus, can have a dark spot as great as 5 feet in diameter at 20 feet when the light bulb is displaced from the focus by about 0.2 inches.

It will now be shown how to eliminate this very undesirable unilluminated region in the center of a broad beam.

The above has shown that the minimum diameter of the parabolic reflector produces the illumination for the outer circumference of the broad beam. Since it is desirable to have a broad beam, it is necessary not to change that surface. However, it is also desirable to direct some of the light from the bulb so as to illuminate the center of the broad beam out to the edge of the dark spot (or the inner edge of the bright ring, which is the same thing said differently). There are several possible reflector configurations that would accomplish this effect.

Figure 4:
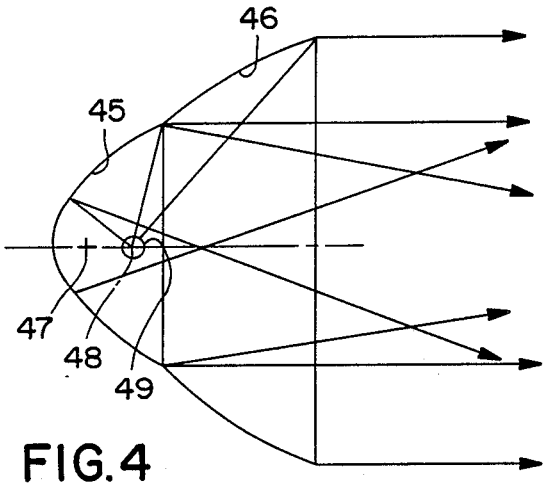
FIG. 4 is a geometric drawing showing the light pattern projected from a reflector having two parabolic sections, and a light source placed at the focus of only one of them.

If a second parabolic surface that has a focus at the displaced bulb position (axially displaced from the focus of the first paraboloid) is used in place of some of the original reflector to form a compound reflector, the center of the broad beam would be illuminated. FIG. 4 illustrates such a compound reflector with parabolic surfaces 45 and 46. Focus 47 is the focus of paraboloid 45. Focus 48 is the focus of paraboloid 46. A light source (bulb) 49 is shown at focus 48. This configuration would produce an illuminated center and an illuminated outer ring, but would have a dark ring between the two areas. This is undesirable. The solution to illuminate the entire broad beam area is to transition from surface 45 to surface 46 with a surface that has a shape which will reflect the light rays in a manner which will illuminate the dark ring. Such a surface should have a slope equal to that of surface 45 where these two join, and equal to surface 46 where these two surfaces meet. One convenient surface that can be employed to join the two paraboloids is the frustrum of a cone as shown in FIG. 6.

Figure 6:
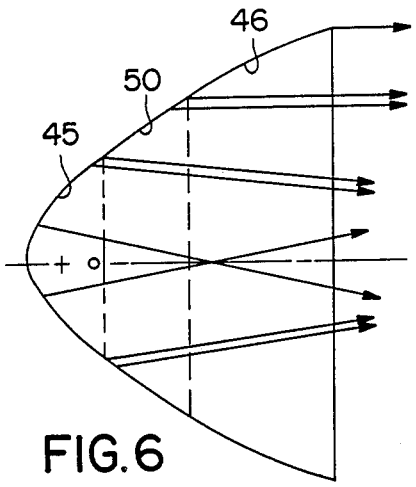
FIG. 6 is a geometric drawing of a reflector surface comprising two paraboloids spaced apart by the zone of a cone.

FIG. 6 illustrates the unique compound reflector of this invention that combines the paraboloids of FIG. 4, with a transition cone 50 as described. The angle of the cone is determined by matching the slope at the transition from paraboloid 45. The cone is continued until it reaches the point where the second paraboloid has the same slope. As a result, there is no abrupt change in the slope and no dark ring will form. There is an infinite number of paraboloids having the two foci.

The choice of the particular two paraboloids is determined by the desire to have uniform illumination over the entire broad beam from the light that is reflected from the first paraboloid, the transition cone and the second paraboloid. Two or three trial designs usually should be sufficient to arrive at the desired compound reflector. The trial and error comes from the process of choosing the size of the three surfaces and determining the angle that is formed between the ends of each surface with the bulb as the apex. The relative values of these angles are a measure of the relative amount of light that is reflected from each surface. Next, the relative areas of the beams that come from each of the three surfaces are determined. Finally, the ratio of the angle to the beam area for each of the surfaces should be equal for uniform illumination. In the illustrated example, the first parabolic reflector is defined by $p=0.461$, the second by $p=0.595$ and the cone has an angle of 35 degrees 8′, with a minimum diameter of 1.266, a maximum diameter of 1.671 and an axial length of 0.287 inches. While this configuration will produce a broad beam with no unilluminated regions, it still must be evaluated as a spot beam. Using the same considerations that were employed to determine the spreading of the beam from the single conventional reflector, the size of the spot beam can be determined and selected.

In the example shown, when the bulb is at the focus of the first parabola, the second paraboloid spreads the central spot beam only about 4 degrees 10′ from the centerline of the reflector at the outer rim and 11 degrees at the transition to the cone. At a distance of 20 feet, the beam from the second paraboloid is about 2.9 feet to 7.8 feet in diameter. A spot beam from the two paraboloids of less than 8 feet is very desirable and the broad beam at almost 18 feet derived from this arrangement having no unilluminated areas is also very desirable. Both are attainable simply by moving the light bulb and the reflector axially relative to one another. Mechanical means (FIG. 17) will be provided to make this shifting motion, either selectably, or intermittently in a pulsating manner.

Figure 5:
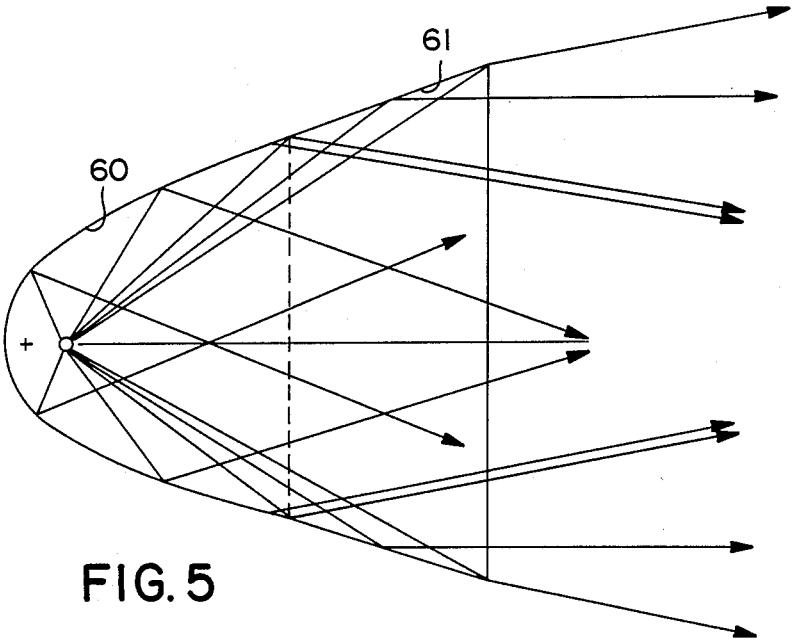
FIG. 5 is a geometric drawing showing the light pattern projected from a reflector comprising a paraboloid and the zone of a cone.

While this compound reflector will produce a bright spot beam or a broad spot beam with no dark spot, the equivalent uniform illumination can be obtained with a much simpler reflector (FIG. 5). The same paraboloid 60 defined by $p=0.461$ out to a value of $y=1.000$ inches and $x=1.085$ inches can be joined to a cone 61 having the same slope (half angle equal to 24 degrees 45′) for an axial distance of 0.911 inches. This compound reflector surface would have an overall length of 1.911 inches and a maximum diameter of 2.84 inches. This is the preferred embodiment of the invention. The focus 62 of the paraboloid is shown as is a bulb 63 that can be moved from the focus to a position displaced from the focus. One of the advantages of this reflector is the simple geometry. When the light bulb is displaced from the focus as shown, the cone will illuminate the center that is not illuminated by the reflections from the paraboloid and would otherwise form a dark spot. The light rays at the paraboloid-cone junction are diverted down across the center line. The rays at the end of the cone are diverted outwardly while the rays from the center of the cone are directed along the axis. As a consequence the light rays are diverted from the outer circumference of the center area into the center point and then again to the outer circumference thus effectively covering the area twice with a very simple geometry.

There are many other compound reflector shapes that will produce a broad beam without dark spots. The basic requirements taught by this invention for a compound reflector having two or more geometric shapes that form the reflector are: (1) the reflector surface near the bulb should be a paraboloid in order to provide a bright spot beam when the bulb is at the focus and a broad beam when the bulb is displaced from the focus, (2) the second surface is at the maximum diameter and should spread the beam very little when the bulb is at the focus of the first surface and should cause the beam to illuminate some or all of the dark spot that would otherwise occur when the bulb is displaced from the focus of the first surface and (3) the two surfaces may be joined if necessary with a smoothly contoured surface that will illuminate any dark ring that may otherwise occur.

Figures 15, 16, 17:
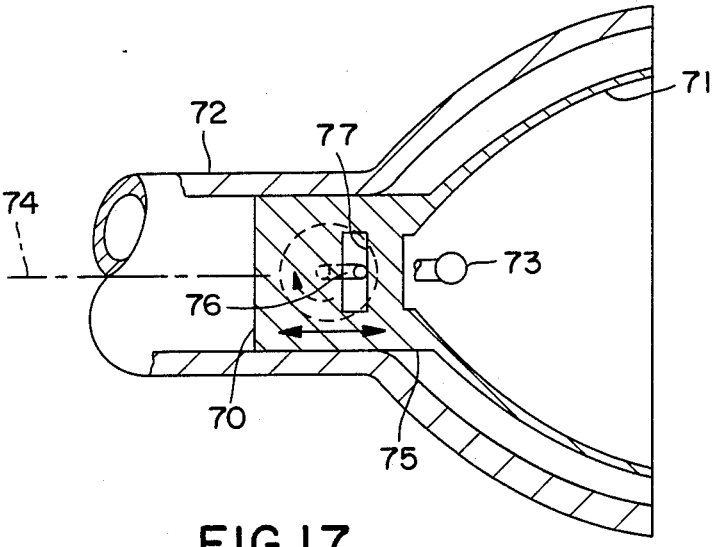
FIGS. 15 and 16 show schemes for producing arrays of light with enhanced perceived brilliance.
FIG. 17 is a semi-schematic showing of means to shift the light source relative to the focus.

Means 70 as shown in FIG. 17 relatively will mechanically shift the bulb and reflector to shift the bulb relative to the focus by moving either the reflector or the bulb. Usually it will be more convenient to move the reflector.

In FIG. 17, reflector 71 according to any embodiment hereof is slidingly mounted to a handle 72. A bulb 73 is fixedly mounted at a location which at the focus of the paraboloid is one of its extreme axial positions along central axis 74. Means 70 moves the reflector from that position to another where the bulb is between the focus and the reflector as previously discussed.

The reflector base 75 may be provided with manual means (not shown) to move it and the reflector axially. Or when an enhanced beam is desired, a cam 76 can rotatably be mounted to the handle to fit in a slot 77 in base 75 to oscillate the reflector continuously between the intended limits of movement. Obviously, similar means could be provided to move the bulb relative to a stationary reflector, but this will rarely be preferred.

It has been shown that a compound reflector constructed according to the teachings of this invention will produce a bright spot beam and a broad beam that is illuminated over the entire area. This is a significant advance over the art and a useful replacement to existing conventional flashlight reflectors. However, this invention can be enhanced even further by making the broad beam appear to be brighter than the true illumination provided by the bulb.

This part of the invention is based on the two phenomena that the human eye retains an after-image and that the human eye produces a signal that exceeds the actual stimuli under certain conditions. However, before describing the operation of the invention, it is first necessary to transfer the two phenomena that relate to a flashing light as previously described to the reaction of the eye to a light that illuminates different areas periodically for example by sweeping across an area, or selectively illuminating parts of an area periodically. For simplicity of explanation, this discussion is limited to a spot beam obtained from a single parabolic reflector.

In standard terminology for image reconstruction, the term "pixel" is used to denote the smallest area of a scene. It will be convenient to refer to the area that is illuminated by the spot beam as that covering one pixel. Now, if the spot beam is moved to illuminate another pixel and then another pixel, the effect is the same as a flash of light on each of the pixels for a duration equal to the time the sweeping light illuminates each of the pixels. The ratio of the area of the broad beam to the area of the spot beam is the same as the number of pixels illuminated. The time it takes for the spot beam to be swept over a series of pixels and then returned to the starting pixel is called the period. The frequency that each pixel is illuminated, for a constant sweep velocity, is equal to the quantity two divided by the period, since each pixel is illuminated twice for each complete sweep returning to the starting pixel. Thus, if the sweep covers an area at a period of one second, the effect would be the same as a light flashing at a frequency of $2/1=2$ hertz. The equivalent flashing light therefore depends only on the cycle period and is independent of the total area that is illuminated by the sweep (although the speed at which the sweep must be made depends upon the total area in order to obtain any given cycle period). The duration of time that each pixel is illuminated would be equal to the period divided by the number of pixels that are illuminated. If the broad beam is developed by moving the spot beam in a strictly linear fashion with each spot beam line of sight being parallel, the number of pixels illuminated will be independent of the range. However, the light source would have to move a large distance.

If the broad beam is developed by rotating the spot beam about a pivot axis to form a rectangular broad beam, the area of the broad beam will be a constant times the spot beam with the actual value dependent on the range to the area that is illuminated. However, in this case, the light source or its reflector need move only a small convenient distance.

The equivalence of a flashing light to a sweeping light based on these parameters has been confirmed by experiments with this invention. It has also been confirmed, and is within the scope of this invention, that pulsing the beam between its spot configuration and its broad beam configuration, as shown in FIG. 17, will provide the same advantages. Thus, while this invention provides a convenient flashlight selectable between a spot beam and a wide beam, it also provides a wide-beam flashlight with enhanced brilliance.

The previous discussion relating to pixels was for a uniform velocity sweep. It will be clear that a variable sweep velocity has advantages in the following discussion. FIGS. 15 and 16 illustrate a spot beam that is to illuminate five pixels. The letter "I" represents the pixel that is illuminated while the letter "X" represents one not illuminated. At time unit one in FIG. 15, the first pixel is illuminated while the other four pixels are dark. At time unit two, the second pixel is illuminated while the other four are dark. This sequential illumination of the pixels follows as illustrated in FIG. 15. The two pixels at the ends of the resulting broad beam are illuminated in a group of two units of time; one being for the sweep to the right and the other for the return sweep to the left. It can be seen that a uniform sweep velocity produces a non-uniform illumination sequence. The pixel number one is illuminated two units of time (2t) and is then dark for 8 t. Pixel two is illuminated 1 t, dark 6 t, illuminated 1and finally dark for 2 t to complete the period (P). Pixel three has 1 t illuminated, 4 t dark, 1 t illuminated and 4 t dark for the period. It should be clear that although each pixel is illuminated for the duration of 2 t each period at an *average* frequency of illumination of 2/P, the pixels have a variety of durations and frequencies within any portion of the period. However, for some applications the period is sufficiently short that the human eye cannot distinguish the differences.

FIG. 16 illustrates a technique to produce equal durations of illumination at equal frequencies for all pixels. In this example, the sweep velocity in one direction is the normal desired speed, but for the return sweep the velocity is very much greater. In this case the human eye does not react to the illumination produced during the rapid return sweep and the effective illuminated/-dark sequence is as shown. The result is a uniform illumination of 1 t followed by darkness for 4 t to complete the period for each of the pixels. There are of course more complex sweep sequences with varying velocities that would produce the equivalent uniform illumination.

The unique reflector of this invention allows the spot beam to be transformed into a broad beam with no areas of non-illumination (dark areas). It is possible to move either the reflector or the bulb of this invention to cause the beam to transistion from a bright spot to an ever decreasing intensity broad beam as shown in FIG. 17. Any suitable manual or powered slide device can be used, so as to relatively shift the bulb and the reflector, usually shifting the reflector. If this motion is controlled at a frequency of about 10 hertz, the result is a broad beam that appears to be appreciably brighter than the one obtained without the oscillation. While the preferred configuration of this invention employs the unique reflectors already shown, it should be obvious to one skilled in the art that a broad beam can be obtained also by merely moving the fixed size spot beam across a scene that is to be illuminated.

For use as a flashlight which can illuminate a small scene with a spot beam or a large scene with a broad beam, there are numerous ways to cause the sweeping motion of the spot beam. The following will describe several techniques by way of example. These are by no means exhaustive and are susceptible to numerous modifications and embodiments within the ability of those skilled in the art without the exercise of inventive faculty.

(1) Mount the entire normal flash light in a flexible holder so that a rotating or oscillating unbalanced weight will cause the entire flash light to vibrate, thereby sweeping the spot beam to form the broad beam. This method has the advantage that any existing flash light can be mounted in the flexible holder to utilize this invention.

Figure 13:
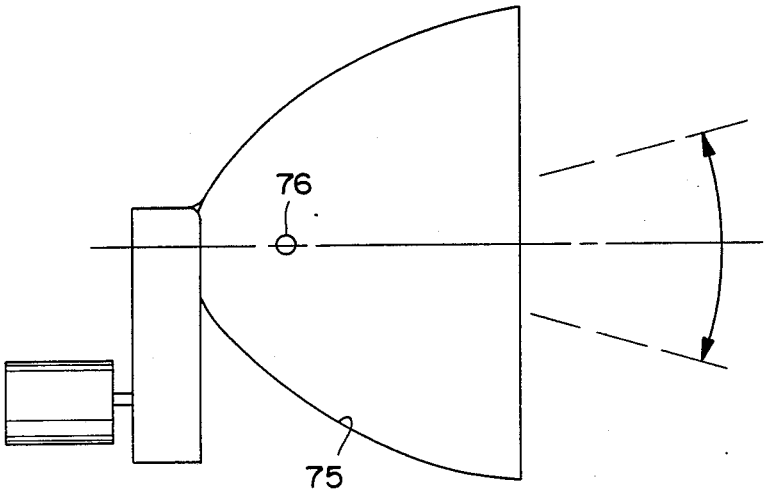
FIG. 13 is a schematic showing of a device projecting an oscillating beam.
Figure 14:
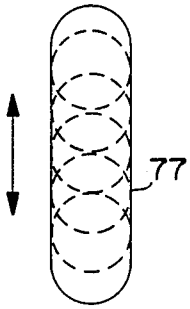
FIG. 14 is a schematic showing of the beam projected by the device of FIG. 13.

(2) The above flash light could be caused to sweep in an oscillatory linear manner by any of many techniques using a small rotating motor and suitable mechanisms to form an oscillating broad beam FIGS. 13 and 14 show the reflector 75 and pivot 76, about which it can be swivelled to form the beam pattern 77 shown in FIG. 14.

Figure 9:
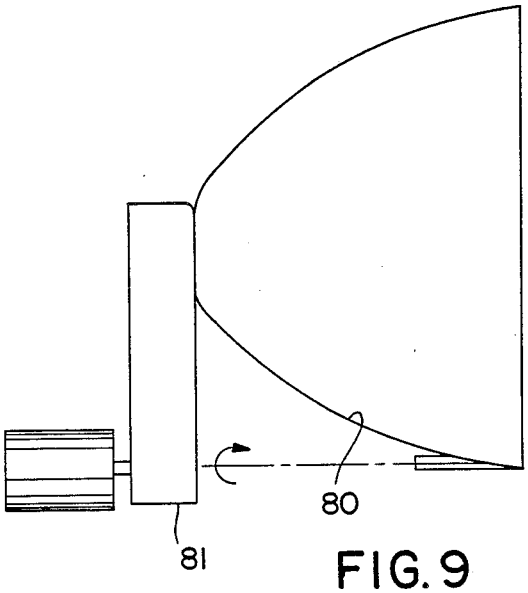
FIG. 9 is a schematic showing of a reflector adapted for mechanically producing an enlarged beam size and increased perceived brightness.
Figure 10:
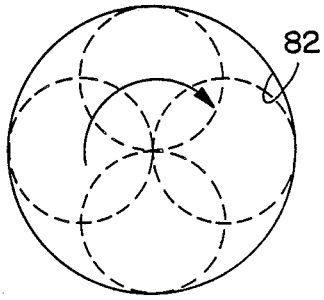
FIG. 10 is a schematic showing of the beam projected by the device of FIG. 9.

(3) The reflector 80 can be caused to move with suitable cam or crank mechanism 81 in a circular fashion to produce a broad circular beam 82 (FIGS. 9 and 10).

Figure 12:
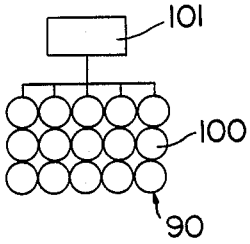
FIG. 12 is a schematic showing of a pulsed array of light sources.

For the application of this invention to larger systems, the spot beam can be swept as described above but also more complex techniques can be utilized. Some of the possible more complex methods follow:

(1) Employ a series of stationary bulb-reflector assemblies 90 each of which will point in a different direction and thereby direct the respective spot beam in a progressively different direction (FIG. 12). In this case the light source from rapid action gas discharge focused bulbs 100 rather than a slow activating resistive filament bulbs will preferably be used and can provide the same effect as a movable stroboscopic spot beam. An electronic multiplexing circuit 101 would illuminate each bulb sequentially for the desired duration and frequency.

Figure 11:
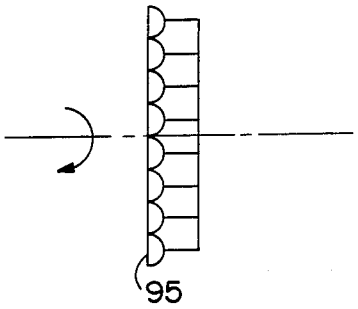
FIG. 11 is a schematic showing of a rotary array of light sources.

(2) Again by adapting the microwave antenna concepts, it is possible to have a linear array 95 of several focused bulbs each of which produces a thin rectangular shaped beam. When this linear array is rotated about its center (as in FIG. 11), a broad circular beam results.

This invention thereby provides an improved adjustable beam flashlight, and in addition can provide a beam of enhanced perceived brightness.

This invention is not to be limited by the embodiments shown in the drawings, and described in the description which are given by way of example and not of limitation, but only in accordance with the scope of the appended claims.

I claim:

1. A flashlight having a projection axis, a light source, and a reflector, said reflector having a specularly reflective surface on said axis which forms a cavity receiving a light source, said reflective surface comprising a paraboloid having a focus, and said flashlight including means for mounting said light source and reflector relative to one another so that said light source can selectively be positioned at said focus to provide a spot beam, or can be displaced axially from said focus to provide a broader beam, said reflector surface further including a frusto-conical surface as a tangent continuation of said paraboloid to reflect light from said source to illuminate a dark section of the beam which otherwise results when the light source is displaced from said focus.

2. A flashlight according to claim 1 in which means is provided for relatively axially shifting said reflector or light source relative to one another in order to selectively provide a spot beam or a broad beam.

3. A flashlight according to claim 1 in which said reflective surface includes a second paraboloid coaxial with said projection axis, tangent to said conical surface and on the other side of it from said first paraboloid, said second paraboloid having a focus on said axis and spaced from the focus of said first paraboloid.

4. A flashlight according to claim 3 in which means is provided for relatively axially shifting said reflector or light source relative to one another in order to selectively provide a spot beam or a broad beam.

5. A flashlight according to claim 2 in which means is provided for repetitively relatively shifting said reflector and said light source between positions where said light source is at the focus of said first paraboloid, and where it is axially displaced therefrom.

* * * * *